US006675408B1

(12) United States Patent
Mason

(10) Patent No.: US 6,675,408 B1
(45) Date of Patent: Jan. 13, 2004

(54) MODULAR AIRPLANE-SHAPED BEDROOM FURNITURE

(76) Inventor: Cecile L. Mason, Rte. 3, Box 308, Enid, OK (US) 73703

( * ) Notice: Subject to any disclaimer, the term of this patent is extended or adjusted under 35 U.S.C. 154(b) by 0 days.

(21) Appl. No.: 10/208,569

(22) Filed: Jul. 30, 2002

(51) Int. Cl.[7] ..... A47B 83/00
(52) U.S. Cl. ..... 5/2.1; 5/907; 5/308
(58) Field of Search ..... 5/2.1, 8, 9.1, 93.2, 5/308, 907; D6/388, 382

(56) References Cited

U.S. PATENT DOCUMENTS

| | | | | |
|---|---|---|---|---|
| 4,027,343 A | | 6/1977 | Hooker | |
| 5,044,024 A | * | 9/1991 | Del Rose | 5/400 |
| 5,623,736 A | | 4/1997 | Soltani et al. | |
| 5,634,225 A | | 6/1997 | Miller, Sr. et al. | |
| 5,754,995 A | | 5/1998 | Behrendt | |
| 5,765,239 A | * | 6/1998 | Moses | 5/2.1 |
| 5,950,257 A | * | 9/1999 | Smith et al. | 5/2.1 |
| 6,086,172 A | | 7/2000 | Lee | |
| 6,109,189 A | | 8/2000 | Tarver | |
| 6,125,484 A | | 10/2000 | Thomson | |
| 6,192,538 B1 | | 2/2001 | Fogel | |

* cited by examiner

*Primary Examiner*—Teri Pham Luu
*Assistant Examiner*—Frederick Conley
(74) *Attorney, Agent, or Firm*—John D. Gugliotta; Olen L. York, III

(57) ABSTRACT

Modular airplane shaped bedroom furniture provides a line of bedroom furniture for children that is in the general shape of an airplane. The body of the airplane incorporates a standard twin size mattress. The nose of the modular airplane shaped bedroom furniture incorporates a clothes hamper and wastebasket, while the top of the nose section provides a desk. The single center-mounted propeller is fixed in place so that it cannot turn and provides hanging hooks for clothes, book bags and the like. The wing section on one side of the modular airplane shaped bedroom furniture is a toy box, while the wing on the other side provides six drawers for storage. Under-bed storage provides room for more drawers or an additional roll away bed for use by another child. The tail section can be used as a bookshelf or for storage of shoes. Finally, the cockpit area can be used for storage of a radio, CD player, small television or the like. All components of the modular airplane shaped bedroom furniture are modular allowing for easy moving and assembly. The use of the modular airplane shaped bedroom furniture provides an alternative to conventional children's furniture that is not only unique and eye-catching but also fun for children too.

11 Claims, 5 Drawing Sheets

MODULAR AIRPLANE-SHAPED BEDROOM FURNITURE

RELATED APPLICATIONS

The present invention was first described in Disclosure Document Registration 505,558 filed on Feb. 11, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to modular bedroom furniture. More specifically, the present invention relates to modular airplane-shaped bedroom furniture.

2. Description of the Related Art

Furniture styling, especially that of bedroom furniture, incorporates a wide variety of styles, borrowing ideas from cultures across the globe in order to achieve a unique, signature style for bedrooms of adults and children alike. For those who are on the cutting edge of modern interior decorating practices, they know all too well that interior design is susceptible to the same type of trends or cyclical popularity as that experienced in the fashion world and other areas. In response to this constant evolution of interior design pieces and methods, interior designers and manufacturers of interior design articles are constantly in need of new and innovative ideas. As furniture, especially bedroom furniture, is often the centerpiece of interior design around which the decor of a room is focused, ideas relating to new designs are held at a premium.

A search of the prior art did not disclose any patents that read directly on the claims of the instant invention; however, the following references were considered related:

U.S. Pat. No. 6,192,538 issued in the name of Fogel, describes a modular mattress system with a removable liquid-filled insert;

U.S. Pat. No. 6,125,484 issued in the name of Thomson, describes a modular bed frame;

U.S. Pat. No. 6,109,189 issued in the name of Tarver, describes a modular and transportable living quarter;

U.S. Pat. No. 6,086,172 issued in the name of Lee, describes a structural assembly system used to form different furniture pieces;

U.S. Pat. No. 5,754,995 issued in the name of Behrendt, describes a modular transformable furniture;

U.S. Pat. No. 5,634,225 issued in the name of Miller, Sr., et al., describes a modular air bed;

U.S. Pat. No. 5,623,736 issued in the name of Soltani et al., describes a modular air bed; and U.S. Pat. No. 4,027,343 issued in the name of Hooker, describes a bed frame with detachable and interchangeable parts.

Consequently, there exists a need for new product ideas and enhancements for existing products in the modular bedroom furniture industry.

SUMMARY OF THE INVENTION

It is therefore an object of the present invention to provide modular bedroom furniture for children in the shape of an airplane.

It is a feature of the present invention to provide a modular airplane-shaped bedroom furniture that combines inexpensive and long-lasting components completely integrated to provide a convenient means for maximizing bedroom space by providing a number storage compartment options.

It is a further feature of the present invention to provide a modular airplane-shaped bedroom furniture that provides an aesthetically pleasing appearance to parents and children.

It is a further feature of the present invention to provide a modular airplane-shaped bedroom furniture that provides a convenient means for moving bedroom furniture in an easy and safe manner.

Briefly described according to one embodiment of the present invention, the modular airplane shaped bedroom furniture provides a line of bedroom furniture for children that is in the general shape of an airplane. The body of the airplane incorporates a standard twin size mattress. The nose of the invention incorporates a clothes hamper and wastebasket, while the side slap of the nose section provides a desk. The single center-mounted propeller is fixed in place so that it cannot turn and provides hanging hooks for clothes, book bags and the like. The wing section on one side of the invention is a toy box, while the wing on the other side provides six drawers for storage. Under-bed storage provides room for more drawers or an additional roll away bed for use by another child. The tail section can be used as a bookshelf or for storage of shoes. Finally, the cockpit area can be used for storage of a radio, CD player, small television or the like. All components of the invention are modular allowing for easy moving and assembly. The use of the modular airplane shaped bedroom furniture provides an alternative to conventional children's furniture that is not only unique and eyecatching but also fun for children too.

The use of the present invention provides users with all of the materials and tools necessary to ensure that a user may easily install, use and maintain a modular airplane-shaped bed furniture.

An advantage of the present invention is that it is specifically adapted for personal use because of the light weight components and the use of inexpensive materials, while providing the structural support and integrity necessary to support the items stored within the furniture.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
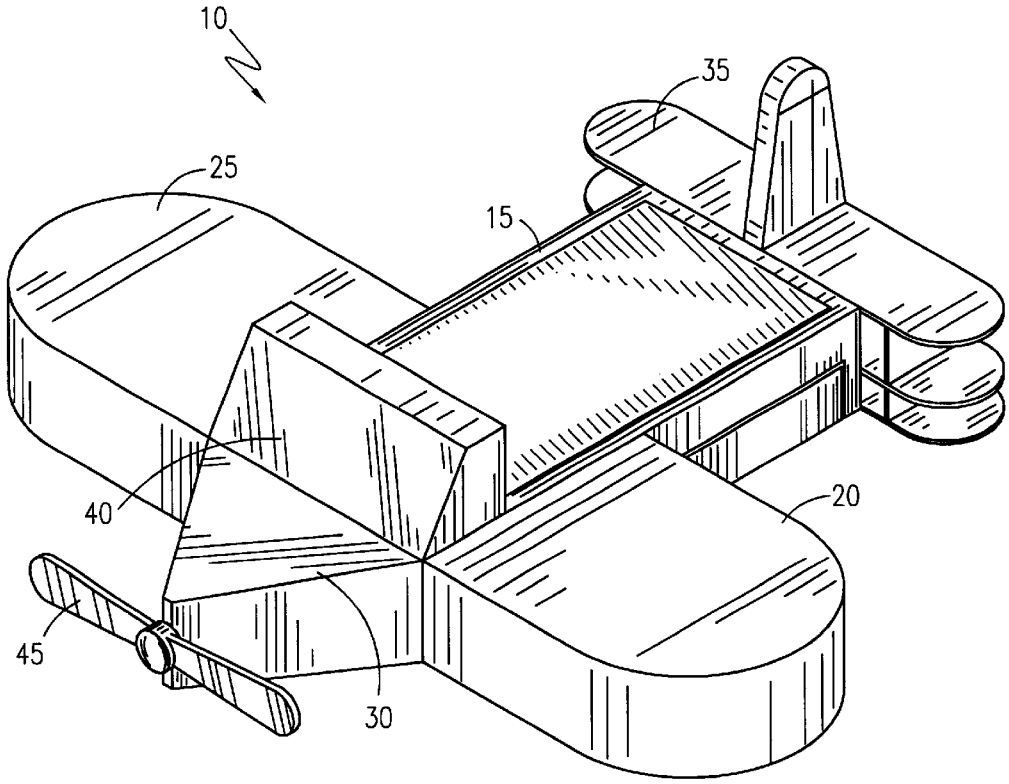
FIG. 1 is an overall isometric view of the modular airplane shaped bedroom furniture, according to the preferred embodiment of the present invention.

Referring now to FIG. 1, an overall isometric view of the modular airplane shaped bedroom furniture 10, in accordance with the preferred embodiment of the present invention, is shown. The overall shape of the modular airplane shaped bedroom furniture 10 is reminiscent of a biplane, but can be adapted to virtually any type of plane including passenger jet, fighter jet, crop duster, or the like. The modular airplane shaped bedroom furniture 10 is envisioned to be used as part of a child's bedroom furniture, and includes virtually every piece of furniture needed to form a complete ensemble. It would be made from wood, wood composite, plastic laminate, steel supports, attaching hardware, and/or other components commonly found in conventional bedroom furniture. The modular airplane shaped bedroom furniture 10 consists of a bed module 15, for the purposes of sleeping and/or additional storage. A first wing module 20 provides for drawer storage of clothing. A second wing module 25 provides for storage of toys or other large objects. A propeller module 30 (triangular in shape in FIG. 1—although it is envisioned that the propeller module shape may be of any suitable geometric shape) provides for a desk surface, storage for soiled clothes and a wastebasket, and a series of hooks for hanging of clothes, book-bags or the like. A tail section module 35 provides, for storage of books, shoes or other objects to be displayed. Finally, an instrument cluster module 40 provides for the storage and use of entertainment items such as a clock radio, stereo equipment, a CD player, and/or a small television. All of the above modules will be described in greater detail herein below. Additionally, each module simply is located adjacent to its respective neighbor and is not fastened together by any physical means.

Figure 2:
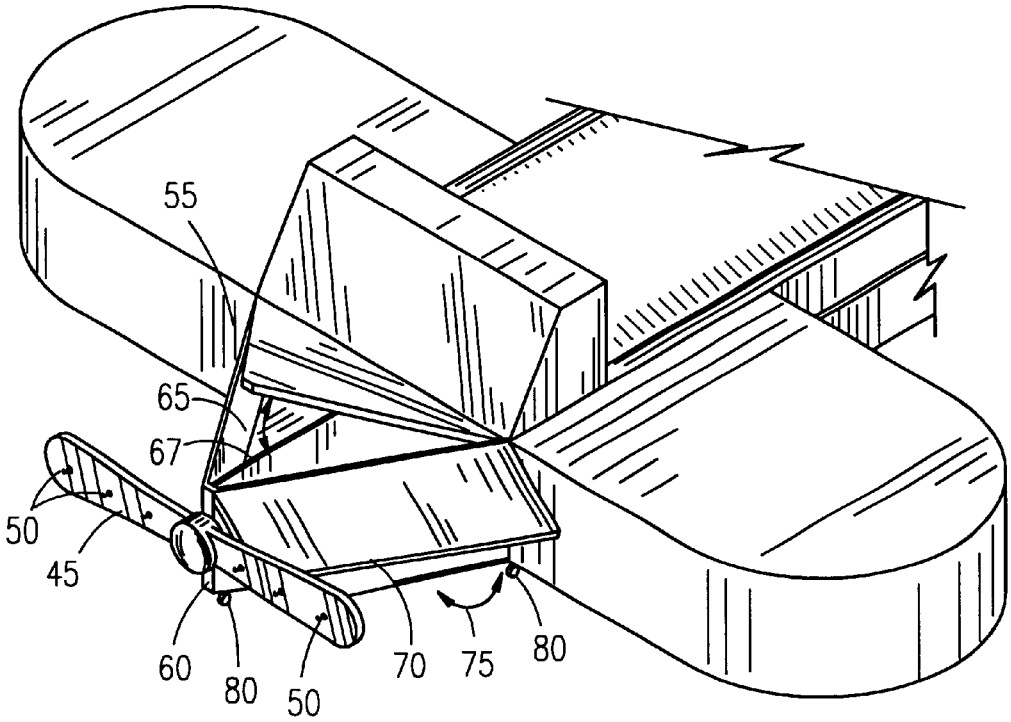
FIG. 2 is a detailed isometric view of the nose and propeller section of the modular airplane shaped bedroom furniture.

Referring next to FIG. 2, a detailed isometric view of the propellor module 30 of the modular airplane shaped bedroom furniture 10 is depicted. A propellor 45 is provided in a permanently fixed, horizontal or near horizontal position as shown. A plurality of hooks 50 is mounted along it length in a linear fashion for the purposes of hanging clothes, book-bags, coats, pajamas and the like. A first cover 55 on a nose section 60 provides access to a first interior storage location 65, which is divided by an interior storage divider 67 and creates two compartments within the first interior storage location 65, for the purposes of storing items such as a waste receptacle or garbage can, and soiled laundry, or the like. The first cover 55 is attached via a hinge and a safety mechanism which prevents rapid falls of the said first cover 55 and possible injury to a user. A writing surface 70 is provided on one side of the nose section 60 which raises and locks into a horizontal position as defined by a first directional path arrow 75. The writing surface 70, used with a user supplied chair, provides for the completion of homework assignments, drawing, coloring, craft projects, and the like. Finally, on the bottom of the propellor module 30 are a series of casters 80 to allow the propellor module 30 to be moved around the bedroom with ease.

Figure 3A:
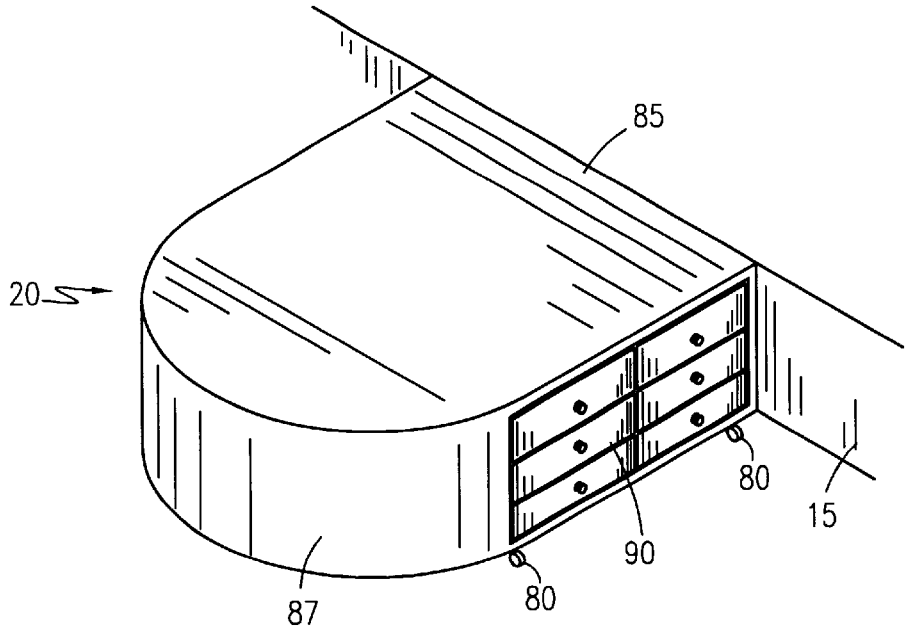
FIG. 3*a* is a detailed isometric view of the first wing of the modular airplane shaped bedroom furniture.

Referring now to FIG. 3*a*, a detailed isometric view of the first wing module 20 of the modular airplane shaped bedroom furniture 10 is shown. The first wing module 20 has a first flat top 85 and a curvilinear wall 87 which, with the sidewall of the bed module 15, forms a storage volume that is indicated by a series of drawers 90. The number and size of drawers 90 can be modified to suit individual tastes, but a quantity of six, as shown, is envisioned as common. The first wing module 20 is shown on the right side of the modular airplane shaped bedroom furniture 10 (as shown in FIG. 1), but can be mirrored on the left side as well to suit individual tastes or needs. Finally, on the bottom of the first wing module 20 are a series of casters 80 to allow the first wing module 20 to be moved around the bedroom with ease.

Figure 3B:
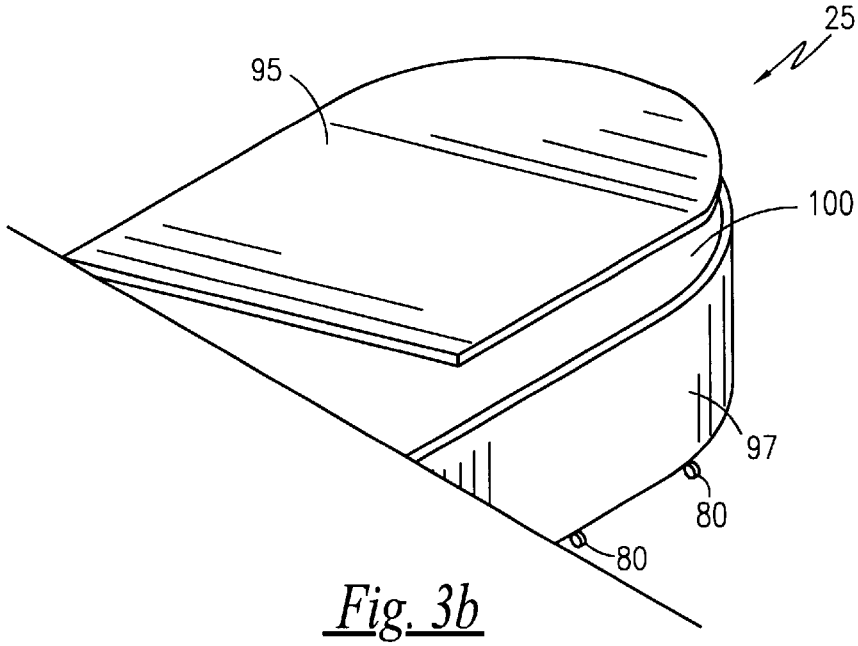
FIG. 3*b* is a detailed isometric view of the second wing of the modular airplane shaped bedroom furniture.

Referring next to FIG. 3*b*, a detailed isometric view of the second wing module 25 of the modular airplane shaped bedroom furniture 10 is disclosed. The second wing module 25 utilizes a second flat top 95 and a curvilinear wall 97 to form a storage volume which is indicated by an enclosed second interior storage location 100 to provid storage for large items such as toys. The second top cover 95 is attached via a hinge and a safety mechanism which prevents rapid falls of the said second top cover 95 and possibly injury to a user. The second wing module 25 is shown on the left side of the modular airplane shaped bedroom furniture 10 (as shown in FIG. 1), but can be mirrored on the right side as well to suit individual tastes or needs. Finally, on the bottom of the second wing module 25 are a series of casters 80 to allow the second wing module 25 to be moved around the bedroom with ease.

Figure 4:
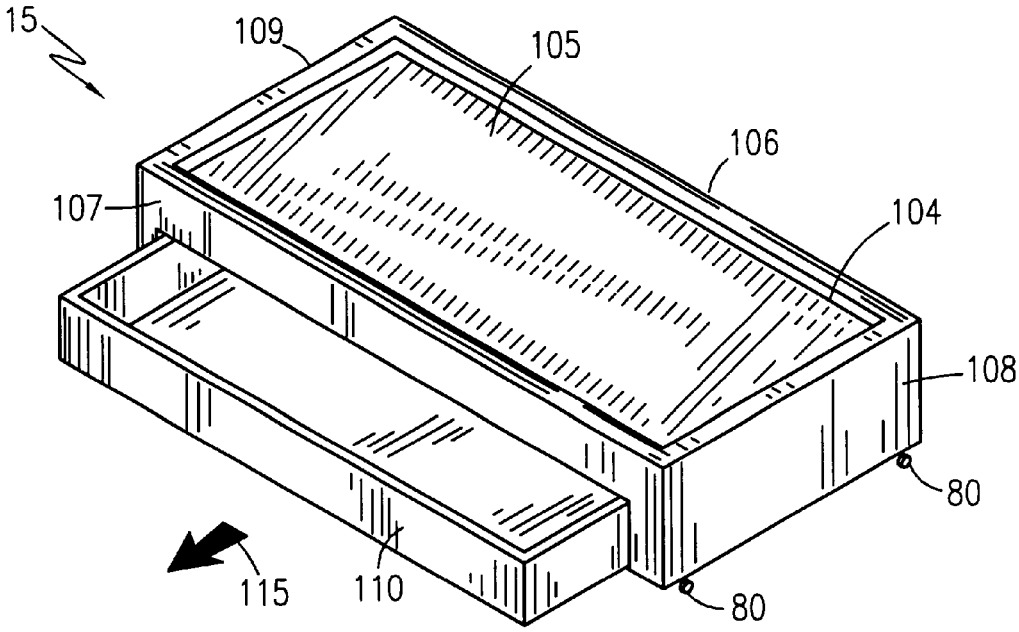
FIG. 4 is a detailed isometric view of the bed section of the modular airplane shaped bedroom furniture.

Referring now to FIG. 4, a detailed isometric view of the bed module 15 of the modular airplane shaped bedroom furniture 10 is depicted and includes four sidewalls 106, 107, 108 and 109, which are perpendicularly depending from one another and form the volume 104 for inserting a mattress 105. The mattress 105 is shown here as a conventional twin size spring mattress, although other sizes and styles, such as a water or air mattress may also be utilized. An extension drawer 110 is provided on the bottom portion of the bed module 15 and may contain another mattress 105, to allow multiple children to use the modular airplane shaped bedroom furniture 10. The extension drawer 110 withdraws from the bed module 15 along a path defined by a second directional path arrow 115. The extension drawer 110 may also be subdivided into multiple drawers to provide additional storage space for out-of-season clothes, toy storage, game storage and the like. Finally, on the bottom of the bed module 15 are a series of casters 80 to allow the bed module 15 to be moved around the bedroom with ease.

Figure 5:
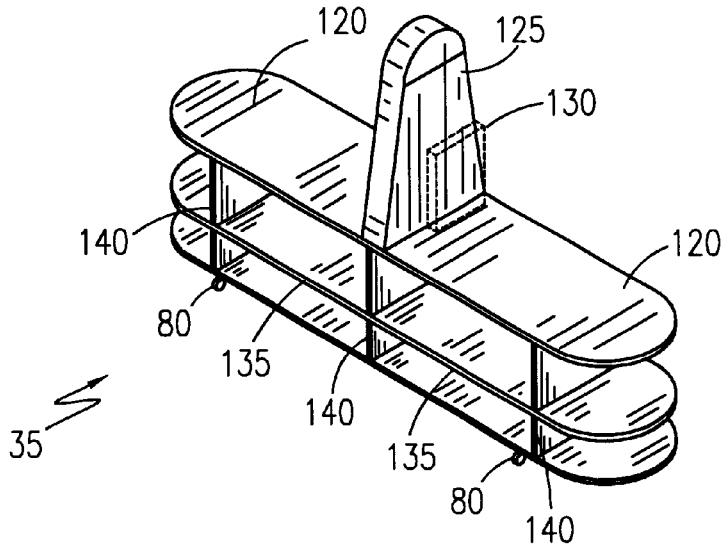
FIG. 5 is a detailed isometric view of the tail section of the modular airplane shaped bedroom furniture.

Referring next to FIG. 5, a detailed isometric view of the tail section module 35 of the modular airplane shaped bedroom furniture 10 is shown. The tail section module 35 provides a third top 120 divided by a rudder divider 125 for decorative purposes, and to provide a stand for supporting of a series of supported objects 130, such as books. A series of storage shelves 135, supported by a series of vertical supporting members 140, provides additional storage for items such as books, shoes, novelty items, trophies, and the like. Finally, on the bottom of the tail section module 35 are a series of casters 80 to allow the tail section module 35 to be moved around the bedroom with ease.

Figure 6:
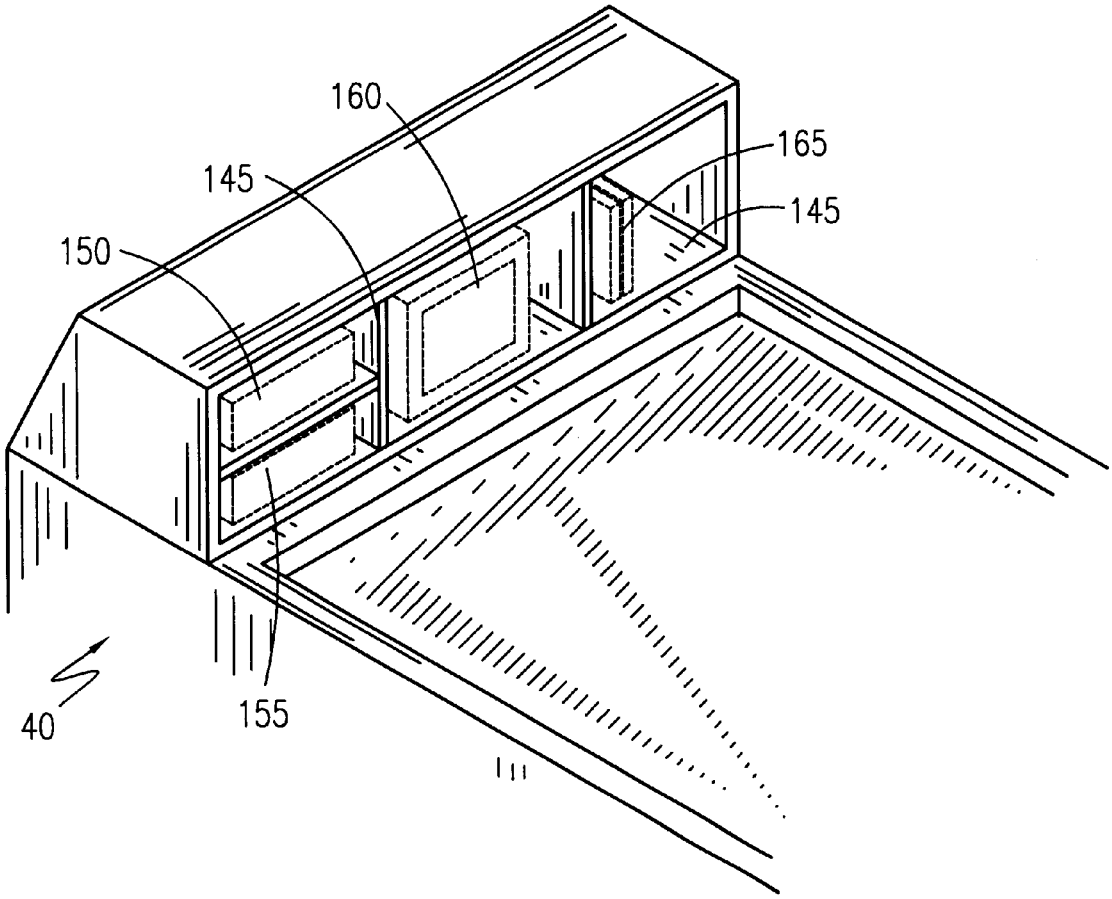
FIG. 6 is a detailed isometric view of the instrument panel of the modular airplane shaped bedroom furniture.

Referring finally to FIG. 6, a detailed isometric view of the instrument cluster module 40 of the modular airplane shaped bedroom furniture 10 is depicted. The instrument cluster module 40 is envisioned to be an optional item on deluxe models of the modular airplane shaped bedroom furniture 10. The instrument cluster module 40 contains a series of small shelves 145 that provides storage for multiple items including, but not limited to, a clock radio 150, an electronic entertainment device 155, and a small television 160. Additionally, a miscellaneous storage 165 provides storage for items such as books and the like.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The present invention is designed with ease of operation features in mind that allow it to be utilized by a common user with little or no training or experience in a transparent manner. After acquisition of the modular airplane shaped bedroom furniture 10, the multiple modules are set up in a child's room in a general configuration as depicted in FIG. 1. Should inadequate space be available, the first wing module 20 or the second wing module 25 can be moved out of position and stored against the walls of the room or in another location. Additionally, depending on the individual needs of the child or children, the first wing module 20 and the second wing module 25 can be either or both a drawer module or a toy box module. Once configured, the modular airplane shaped bedroom furniture 10 is ready for use.

The modular airplane shaped bedroom furniture 10 is utilized for sleeping at night in a manner identical to that of a conventional bed. Soiled clothes are placed in a hamper located in the propellor module 30, while clean clothes can be stored on the hooks 50 of the propellor 45, or in the drawers 90 if so equipped. School work and other similar activities are performed on the writing surface 70. Personal items and toys are stored on or in the second interior storage location 100 and/or the tail section module 35. Entertainment functions are provided by the devices located in the instrument cluster module 40. As equipped, the modular airplane shaped bedroom furniture 10 provides fun and functional care and organizational functionality for all types of children.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. An airplane-shaped modular bedroom furniture comprising:

a bed module for housing a mattress, a first wing module providing clothing drawers, wherein said first wing module comprises a first top and a curvilinear wall thereby forming a plurality of storage drawers;

a second wing module providing storage drawers;

a propellor module providing a desk surface and a storage area;

an instrument panel module providing storage for a television, radio, or stereo equipment; and a tail section module providing book shelves.

2. The modular furniture of claim 1, wherein said first wing module further comprises a plurality of caster for moving said first wing module.

3. The modular furniture of claim 1, wherein said instrument module comprises a plurality of shelves for storing a television, a clock, a radio or stereo equipment.

4. The modular furniture of claim 3, wherein said instrument module further comprises a plurality of casters for moving said instrument module.

5. The modular furniture of claim 1, wherein said bed module is rectangular and is formed by four sidewalls perpendicularly depending from one another.

6. The modular furniture of claim 5, wherein said bed module further comprises an extension drawer below the mattress of said bed module.

7. The modular furniture of claim 6, wherein said bed module further comprises a plurality of rolling casters for moving the bed module.

8. An airplane-shaped modular bedroom furniture comprising:

a bed module for housing a mattress;

a first wing module providing clothing drawers, a second wing module providing storage drawers, wherein said second wing module comprises a second top and a curvilinear wall thereby forming an internal storage volume, wherein said second top is attached to said curvilinear wall via a hinge;

a propellor module providing a desk surface and a storage area;

an instrument panel module providing storage for a television, radio, or stereo equipment; and a tail section module providing book shelves.

9. The modular furniture of claim 8, wherein said second wing module further comprises a plurality of casters for moving said second wing module.

10. An airplane-shaped modular bedroom furniture comprising:

a bed module for housing a mattress;

a first wing module providing clothing drawers, a second wine module providing storage drawers, a propellor module providing a desk surface and a storage area, wherein said propellor module comprises a first cover, wherein said first cover is attached to said propellor module via a hinge, a pair of sidewalls, wherein said sidewalls perpendicularly depend from said first cover and form a propellor module storage volume, a divider wall, wherein said divider wall divides said propellor module storage volume, a writing surface, wherein said writing surface is raised for use and lowered for non-use, a propellor, wherein said propellor is a linearly elongated member attached to said propellor module about a hub, a plurality of hooks, wherein said hooks are perpendicularly attached to said propellor for hanging, and a plurality of casters for moving said propellor module;

an instrument panel module providing storage for a television, radio, or stereo equipment; and a tail section module providing book shelves.

11. An airplane-shaped modular bedroom furniture comprising:

a bed module for housing a mattress;

a first wing module providing clothing drawers;

a second wing module providing storage drawers, a propellor module providing a desk surface and a storage area;

an instrument panel module providing storage for a television, radio, or stereo equipment; and a tail section module providing book shelves wherein said tail section module comprises a linearly elongated third top, a plurality of linearly elongated storage shelves, a rudder vertically dividing said third top and storage shelves, a plurality of vertical support members for supporting said third top and storage shelves, and a plurality of caster for moving said tail section module.

* * * * *